United States Patent [19]

Frey

[11] Patent Number: 4,671,743

[45] Date of Patent: Jun. 9, 1987

[54] PISTON PUMP

[75] Inventor: Bernhard Frey, Schaffhausen, Switzerland

[73] Assignee: Hydrowatt Systems Limted, London, England

[21] Appl. No.: 493,780

[22] Filed: May 12, 1983

Related U.S. Application Data

[63] Continuation of Ser. No. 159,617, Jun. 16, 1980, abandoned.

[30] Foreign Application Priority Data

Jun. 20, 1979 [CH] Switzerland ..... 5779/79

[51] Int. Cl.[4] ..... F04B 23/08; F01B 19/00

[52] U.S. Cl. ..... 417/205; 417/273; 92/86.5; 92/48; 92/105; 92/153; 92/156

[58] Field of Search ..... 417/273, 205; 91/491, 91/492; 92/129, 93, 48, 86.5, 105, 153, 156

[56] References Cited

U.S. PATENT DOCUMENTS

| | | | |
|---|---|---|---|
| 781,678 | 2/1905 | Richwood | 417/273 |
| 2,064,750 | 12/1936 | Hurst | 92/129 |
| 2,179,354 | 11/1939 | Scott | 92/129 |
| 2,364,111 | 12/1944 | Tucker | 417/273 |
| 2,472,355 | 6/1949 | Whittingham | 417/273 |
| 3,554,090 | 6/1971 | Wallace | 91/491 |
| 3,703,342 | 11/1972 | O'Conner | 92/93 |
| 3,854,383 | 12/1974 | Paynter | 91/492 |
| 4,080,107 | 3/1978 | Ferrentino | 417/273 |
| 4,424,739 | 1/1984 | Hovorka | 92/153 |

*Primary Examiner*—Carlton R. Croyle
*Assistant Examiner*—Paul F. Neils
*Attorney, Agent, or Firm*—Tarolli, Sundheim & Covell

[57] ABSTRACT

In the case of piston-machines and in particular those having an elastically deformable sealing tube between the piston and the cylinder, which causes a relatively large structural length of the cylinder-piston arrangement and is provided if necessary with a forced feed for the lubricant, a reduction in the space requirement, in particular the structural length of the cylinder-piston arrangement is achieved by a driving member (30) associated with each piston (20) and embracing the associated cylinder (25) externally and extending over at least part of the length of the cylinder, and frictionally connected, e.g., to a rotating driving mechanism (10). The pulsating secondary space (35) formed by the driving member (30) at the outside of the cylinder (25) is connected for the avoidance of shock pressures because of filling with lubricant liquid flowing away, through a balancing channel (40) of large cross-sectional area to a pressure-balancing chamber (110). For further reduction in the space requirement the often necessary lubricant cooling may be effected by means of a heatex-changer (210) to which the lubricant and the working medium of the piston machine are admitted and which is arranged advantageously inside a lubricant storage chamber or collector (110).

17 Claims, 7 Drawing Figures

PISTON PUMP

Figure 1:
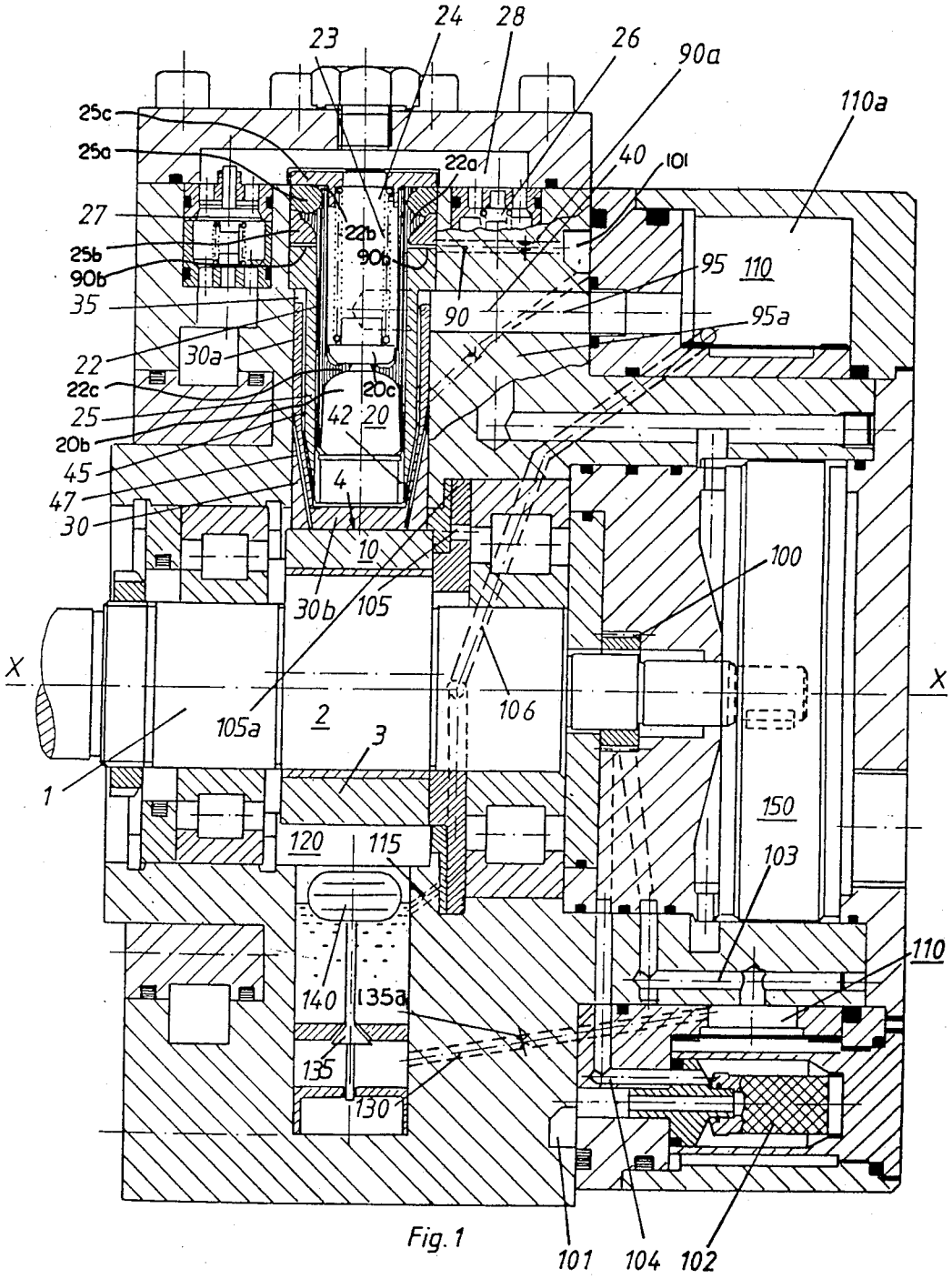

This application is a continuation of application Ser. No. 159,617 filed June 16, 1980, now abandoned.

The invention refers to a driving motor or work machine, in particular a piston-pump, having at least one cylinder-piston arrangement for the formation of a pulsating working space, in particular having a flexibly deformable preferably tubular sealing member which serves to seal the working space and which bears via a liquid, in particular a lubricant, for sliding against a bearing surface, where a driving mechanism, in particular a rotary driving mechanism is provided for the piston. Machines of this kind are known, for example, from West German O/S 25 54 733.

Piston-machines which generally exhibit a crank or eccentric drive are fundamentally burdened with a comparatively high structural outlay and space requirement for the driving mechanism with respect to the usable swept volume. This applies in particular for the known piston-pumps having an elastically deformable sealing tube because the deformation during the stroke with respect to the stretching of the sealing material permissible in continuous service amounts to only a fraction of the length of tube. The structural length of the cylinder-piston arrangement with respect to the usable swept volume is thereby increased. Devices for the execution having support of the elastically deformable sealing tube by means of pressure lubrication have a similar influence. There exists therefore in the case of piston machines in general and in particular in the case of those of the kind mentioned above a need for reduction in the space requirement, as far as possible without essential increase in the structural outlay and whilst preserving a comparatively simple construction.

The object of the invention is therefore the creation of a piston driving motor or work machine which is distinguished by a comparatively short structural length of the cylinder-piston arrangement inclusive of the adjoining parts of the driving mechanism. The solution of this problem is characterized in accordance with the invention by the features specified in claim 1. The construction as therein provided form, of the driving member to surround the cylinder, being, for example, a plunger or the like, of a kind ordinary in itself, which cooperates with an eccentric driving mechanism, enables with the same length for bearing and guidance of this driving member—oscillating to correspond with the working motion—fundamentally a considerable shortening of the structural length of the cylinder-piston arrangement. The readily possible thinwalled construction of the section of the driving member which surrounds the cylinder, moreover allows the avoidance of a considerable increase in diameter of the cylinder-piston arrangement. The reduction in the structural length of the cylinder-piston arrangement becomes particularly advantageously noticeable in the case of star-shaped multi-cylinder arrangements, because this structural length reduces the overall diameter of the pump.

In the case of constructions of the present kind there results on the outside of the cylinder enclosed by the driving member corresponding with the oscillating working motion of the latter, a pulsating secondary space which in the case of ordinary pistons with seepage from the working space or respectively in the case of hermetical sealing of the working space by means of the aforesaid elastically deformable sealing tube supported by pressure lubrication, can fill with the discharged lubricant. For mastery of the problems resulting from this, of the carrying away of the liquid, an advantageous further developement of the invention provides for at least one balancing channel of large cross-sectional area between the pulsating secondary space and a pressure-balancing chamber. Shock pressures inside the cylinder-piston arrangement are thereby avoided in a simple way and in particular satisfactory carrying away is guaranteed even of fairly large throughput quantities of lubricant. In that case a storage chamber which exists in any case for lubricant or conveying medium (with regard to the carrying away of circulating lubricant or respectively leaking conveying medium out of the working space) is advantageously provided as the pressure-balancing chamber for the pulsating secondary space.

A further development of the invention, extending from the aforesaid aspects, provides that the pulsating secondary space is connected through a choke channel to a space which lies at the end of the cylinder inside the driving member and pulsates to correspond with the oscillating working motion. Through this construction the pulsating space between the end of the cylinder and the driving member in which collects the lubricant escaping from the cylinder or from the sealing tube or respectively the seepage from the working space, is employed as a pumping or auxiliary working space for the continuous ejection of the liquid which collects, in which case the choke channel in a particularly simple way restricts the return of the liquid from the secondary space relieved of pressure at the other end of the driving member to a small amount. Hence the choke channel acts after the style of a non-return valve.

Another further development of the invention which may be applied particularly advantageously in combination with the aforesaid features of the invention, but if necessary also independently of them in the case of other kinds of driving motors or work machines, e.g., piston machines, refers to a forced-feed lubrication such as may be employed in particular for the lubrication and support of an elastically deformable sealing tube in the case of its sliding motion against a bearing surface. In the case of a machine having forced-feed lubrication which exhibits a pressure lubrication pump, a return collector, a return pump and a storage chamber feeding the pressure lubrication pump, this further development of the invention is characterized by a bypass channel connecting the storage chamber to the return collector and having an adjustable or controllable correcting member for restriction of the flow from the storage chamber to the return collector. This construction in a simple way enables reliable filling and thereby satisfactory operation of the return pump and hence the maintenance of the lubricant pressure essential to the overall safety in operation. This is particularly significant in the case of high-pressure pumps having lubricated sealing tubes, because a breakdown of the lubrication at the bearing surface may very quickly have damage to the sealing tube as a result.

Driving motors and work machines, in particular piston-machines, of the present kind, in the case of high power-densities demand special measures for reliable lubrication of the highly loaded bearing points and the sliding surfaces of the piston. For doing this in general a forced-feed lubrication is provided with a lubricant cooling device. The object of the invention, namely, primarily the reduction of the space requirement whilst preserving a comparatively low structural outlay extends accordingly also to the construction of the forced-feed lubrication and in particular the cooling device, because these structural units—above all the cooling device—in the case of ordinary executions exhibit comparatively large dimensions.

In solution of the posing of the problem as regards the forced-feed lubrication and the cooling device it is in accordance with the invention provided that the cooling device exhibits at least one heat exchanger to which the lubricant and the working medium of the machine are admitted. In this way not only can the usual costly and spatially large devices for the admission to coolers or heat exchangers of external cooling media, say, outside air set in motion by a fan, be saved, but on the contrary particularly advantageous possibilities of integration of such a heat exchanger into the machine housing also result, from which follows a further saving of space. In that case it proves particularly advantageous to arrange the heat exchanger in the region of a lubricant storage chamber or collector of the forced-feed lubrication.

A further development of the invention refers to that known construction of work machines made as pumps, in which a prefeed pump for pressure-feeding the working medium to the inlet side of the pump is provided. A particularly intensive exchange of heat between the working medium and the lubricant and thereby again the possibility of reducing the space for the cooling device results if instead in accordance with the invention the working medium inlet side of the heat exchanger is connected to the outlet side of the prefeed pump. The prefeed pump which exists anyhow is thereby made use of for forced circulation of the cooling working medium in the lubricant heat exchanger. A particularly advantageous execution results in this connection by the construction of the working medium system of the heat exchanger as a return flow branch between the outlet side and the inlet side of the prefeed pump. In order in this case to keep the return flow of the working medium within proper limits, in accordance with an advantageous refinement of the invention a choke, preferably an adjustable choke, may be arranged in the heat exchanger return flow branch.

Figure 1A:
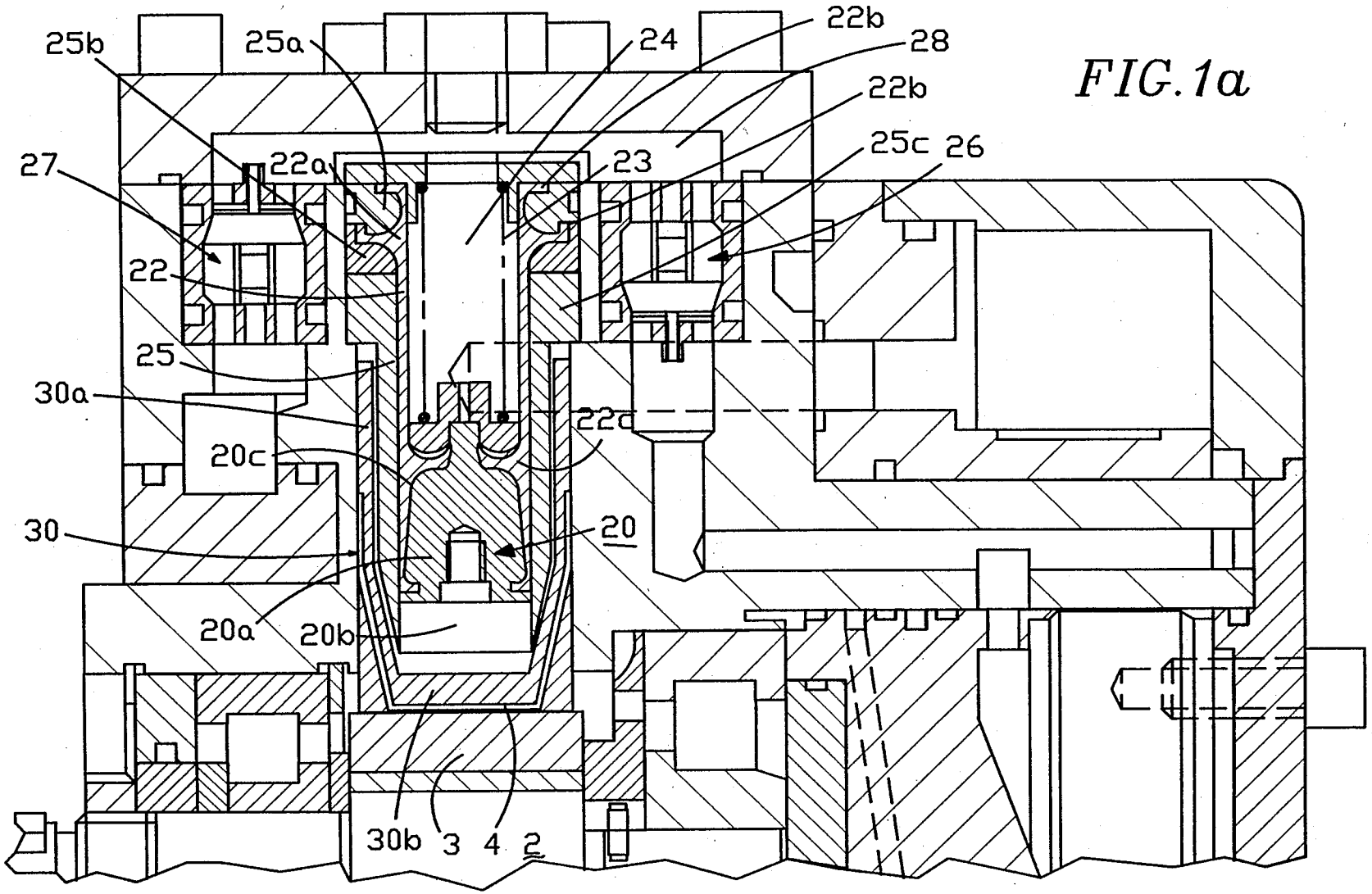
Figure 2:
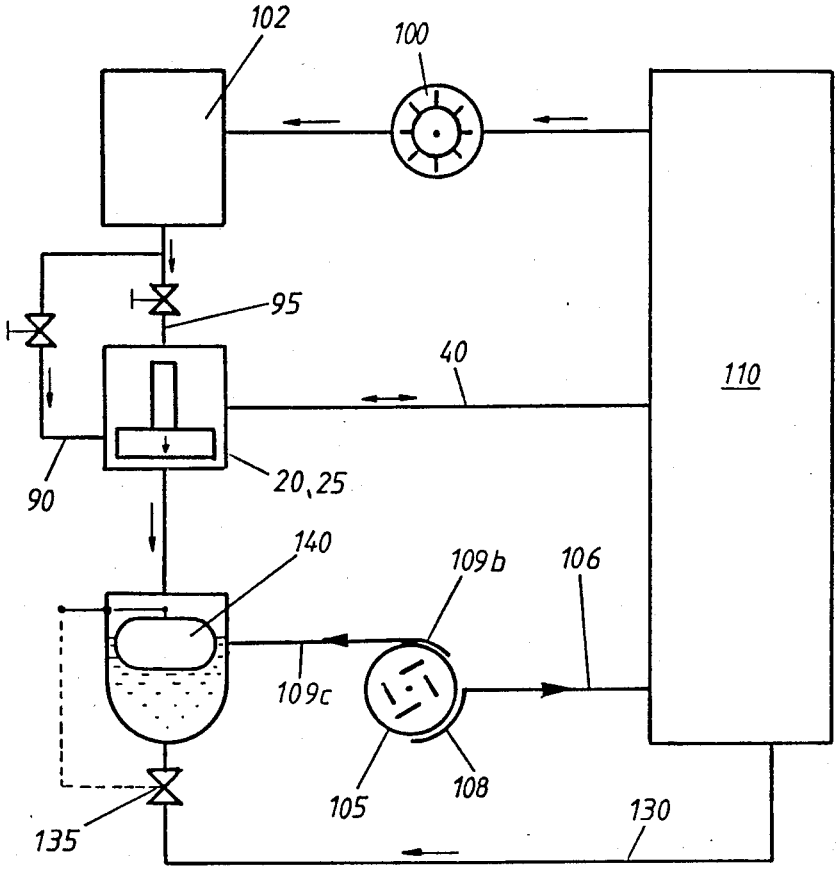
Figure 3:
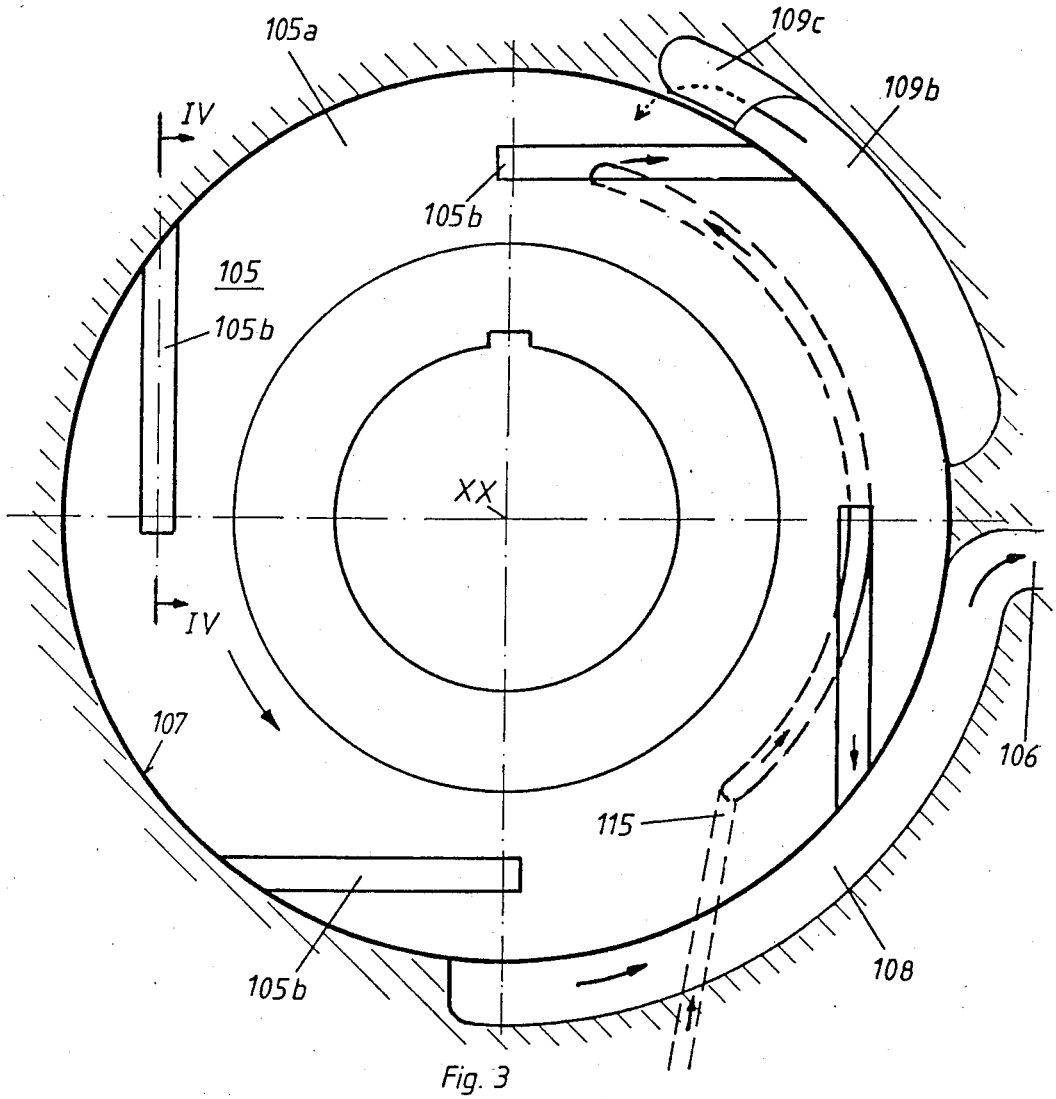
Figure 4:
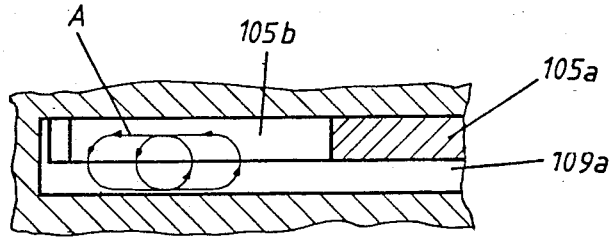
Figure 5:
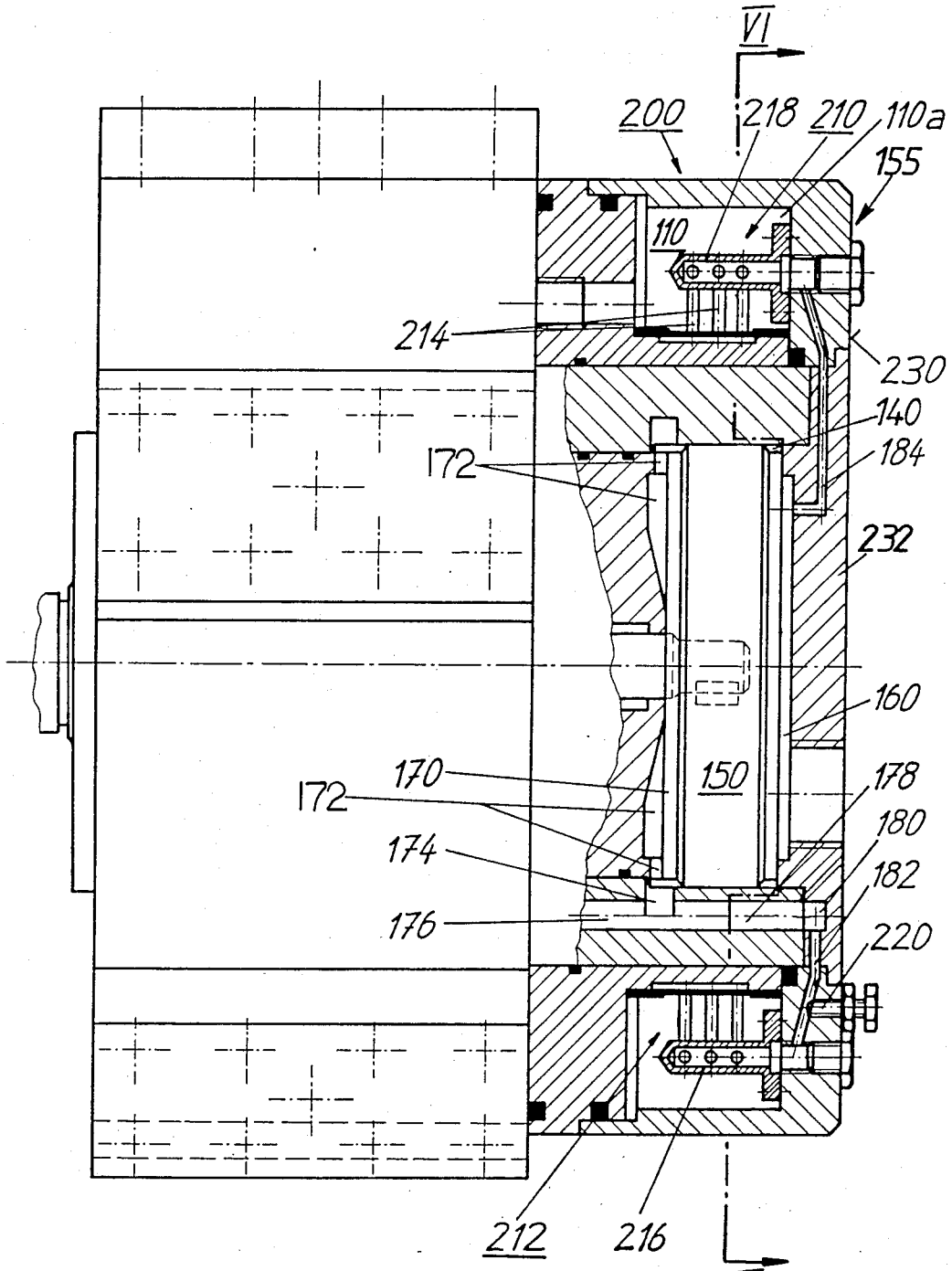
Figure 6:
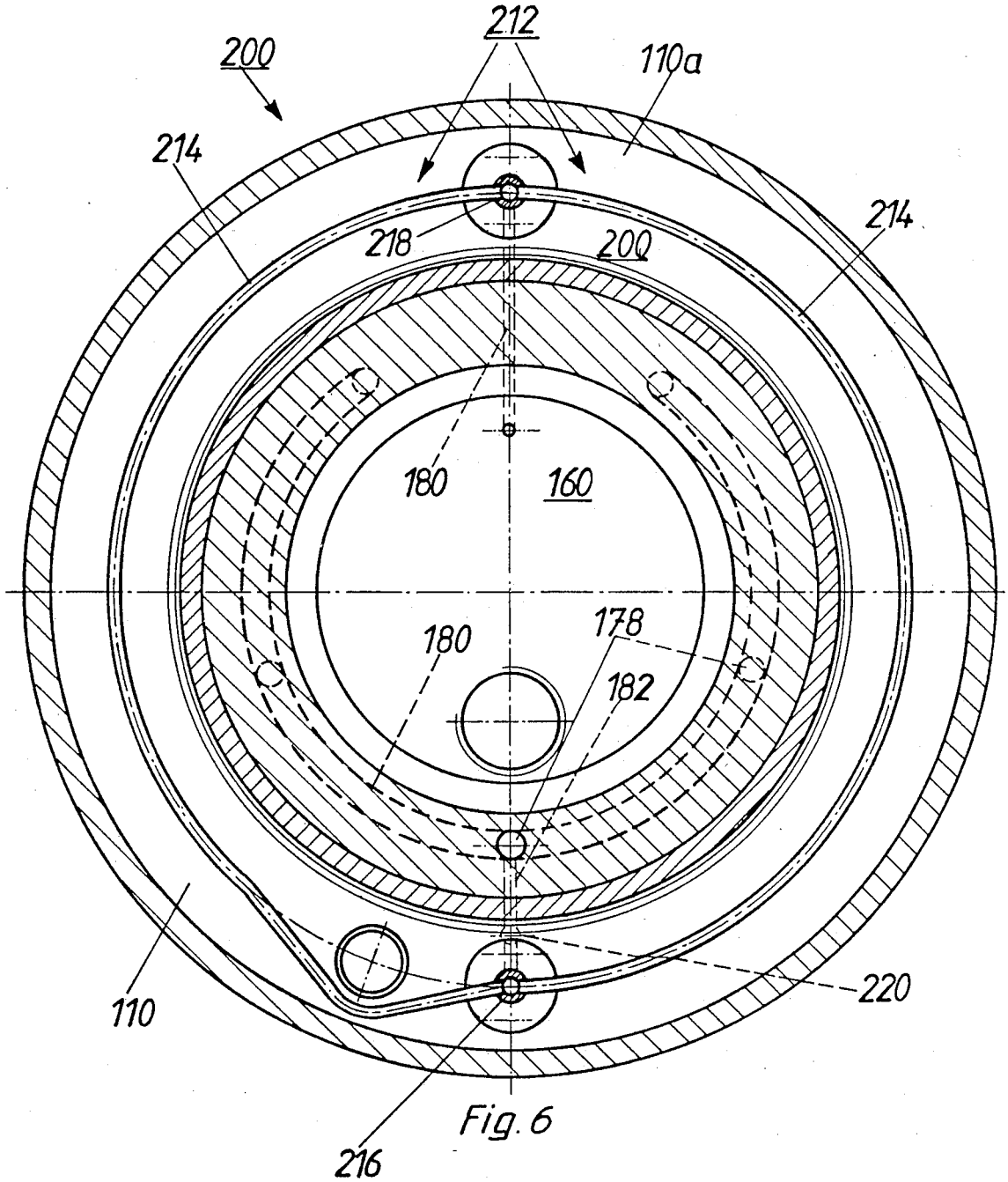

Further features and advantages of the invention are explained with the aid of embodiments illustrated in the drawings. There is shown in:

FIG. 1 - an axial section through a piston pump having a star-shaped multi-cylinder arrangement with an eccentric drive;

FIG. 1*a* - is an enlarged fragmentary view of a portion of FIG. 1;

FIG. 2 - the basic circuit diagram of the lubrication system of the pump as in FIG. 1;

FIG. 3 - on a larger scale an axial elevation of a return pump of the lubrication system of the pump as in FIG. 1; and FIG. 4 - a partial section of the pump runner in accordance with FIG. 3, corresponding with the plane of section IV—IV;

FIG. 5 - a partial axial section through the pump, similar to FIG. 1, but with a modified region of the prefeed pump and of the lubricant storage chamber with the heat exchanger inserted; and FIG. 6 - a cross-section through the machine in the region of the lubricant storage chamber with heat exchanger, along the plane of section VI—VI in FIG. 5.

The driving mechanism 10 of the pump consists as in FIG. 1 of a shaft 1 coupled to a motor (not shown) and having an eccentric 2 upon which is supported a non-rotating slidepiece 3 circulating in translation and having a number of tangential pressure areas 4 corresponding with the number of cylinders—here, for example, five. In FIG. 1 such a pressure area is indicated in operative connection with a driving member 30 of a piston 20 which is connected to an elastically deformable sealing tube 22. A spiral spring 23 forces the piston 20 against the bottom section 30*b* of the sleeve-shaped driving member 30 and puts the sealing tube under axial tensile prestress. The sealing tube is seated in the bore of a cylinder 25 to which it is firmly connected at the top end, and hence hermetically seals the working space 24 formed inside the tube. This working space alters its volume to correspond with the oscillating motion of the driving member 30 and in combination with non-return valves 26 and 27 which are connected to a delivery and suction channel 28, generates the pump action. The working space 24 inside the deformable sealing tube 22 and the delivery and suction channel 28 form a pumping chamber. The size of the pumping chamber is varied by the action of the eccentric 2 on the slidepiece 3, driving member 30 and piston 20. This rotation of the eccentric 2 causes the slidepiece 3, driving member 30 and piston 20 to reciprocate. Reciprocation of the piston 20 deforms the sealing tube 22 to vary the size of the space 24. As the size of the space 24 increases, fluid is drawn through the nonreturn valve 26 into the channel 28 and the space 24 decreases, fluid is discharged form the space 24 and channel 28 through the nonreturn valve 27.

The sealing tube 22 may be connected to the top end of the cylinder 25 in any desired manner, for example, the manner disclosed in the aforementioned West German Offenlegungsschrift No. 25 54 733. In the present instance, a pair of clamp rings or members 25*a* and 25*b* cooperate with a stationary cover member 25*c* to grip a thickened upper region 22*a* of the tube 22 having ridges 22*b* thereon. A suitable adhesive or chemical bonding may be provided between the ridges 22*b* and the members 25*a*, 25*b* and 25*c* if desired.

The lower end of the sealing tube 22 may be connected with the piston 20 in any desired manner, for example, the manner disclosed in West German Offenlegungsschirft No. 25 54 733. In the present instance, the piston 20 has an upper end or head portion 20*c* which is directly above a body portion 20*b* of the piston. A lower end or body portion 20*b* of the piston 20 is fixedly connected to a thickened lower end portion 22*c* of the sleeve 22. The thickened lower end portion 22*c* of the sleeve 22 is fixedly connected to the body portion 20*b* of the piston 20 by means of a physical adhesive or chemical bonding.

The lubrication system of the pump is made as forced-feed lubrication with a pressure lubrication gear pump 100, a return collector 120 surround the eccentic 3 of the driving mechanism and having an annular storage chamber 110 surrounding concentrically the axis XX of rotation of the driving mechanism, as well as a return pump 105 which delivers out of the return collector 120 into the storage chamber 110. This construction and arrangement of the storage chamber makes possible a particular space-saving multi-cylinder pump construction having symmetrical distribution of the connections to the individual cylinders round the circumference of the ring. The integration of the storage chamber into the cylindrical housing of the star-shaped multi-cylinder arrangement also serves the same purpose.

The pressure lubrication pump 100 draws out of the storage chamber 110 via channel 103 and discharged to a channel 104 as well as a filter 102. The output from the filter 102 is into an annular distributor channel 101 out of which pressure channels 90 and 95 having adjustable chokes 90*a* and 95*a* respectively lead to the individual cylinders. The lubricant liquid under pressure from the channel 90 is fed to the support of the sliding motion of the outer face of the sealing tube 22 and flows down in the direction axial to the cylinder (downwards in accordance with FIG. 1) into a pulsating space 42 formed in the region of the bottom end of the piston and cylinder. This space is connected via a choke channel 45 which is made as a clearance volume between the inner face of the cylindrical section 30*a* of the driving member 30 and the outside of the cylinder 25, to a likewise pulsating secondary space 35 formed at the top end of the cylindrical section 30*a*. In this way the lubricant liquid flowing down in the space 42, relieved of pressure, is delivered into the secondary space 35 via the choke channel 45 acting almost as a non-return valve, so that the space 42 acts essentially as a low-pressure space for undisturbed flowing-down of the lubricant out of the clearance volume between the sealing tube and the cylindrical bore or bearing surface respectively. For this automatic discharge pumping action low-pressure is moreover also necessary in the secondary space 35. For that purpose the latter is connected via a balancing channel 40 of a large cross-sectional area to the storage chamber 110 which hence serves as a pressure-balancing chamber.

During operation of the pump, the shaft 1 rotates the eccentric 2. Rotation of the eccentric 2 allows the driving member 30 to move downwardly relative to the stationary cylinder 25 under the influence of the spring 23. As the driving member 30 moves downwardly, the elastically deformable sealing tube 22 is stretched to expand the working space 24 in the manner disclosed in German Offenlegungsschrift No. 25 54 733. This results in fluid being drawn through the valve 26 into the channel 28 and into expanding the working space 24.

In addition, as the driving member 30 moves downwardly relative to the stationary cylinder 25, lubricating fluid flows through the passage 90 to an annular space 90*a*. The lubricating fluid flows from the space 90*a* between an outer side surface of the stretching sealing tube 22 and an inner side surface of the cylinder into the space 42. Since the working member 30 is moving away from the stationary cylinder 25, the space 42 expands as the sealing tube 22 is stretched. At this time the space 35 is also expanding and the length of the choke channel 45 is decreasing. Therefore, lubricating fluid flows from the pressurized distributor channel 101, through the passage 90 into the space between the stretching elastic tube and the inside of the cylinder 25. The lubricating fluid flows downwardly along the outside of the elastic tube 22 to the relatively low pressure space 42. Lubricating fluid flows from the space 42 through the choke channel 45 to the space 35 and the low pressure storage chamber 110.

Continued rotation of the eccentric 2 causes the slidepiece 3 to move the driving member 30 upwardly. As this happens, the piston 20 is moved upwardly against the influence of the spring 23. As this occurs, the size of the working space 24 decreases. The resulting increase in fluid pressure in the working space 24 forces the outer side surface of the elastic sealing tube outwardly against the lubricant coated inner side surface of the cylinder 25. The increase in pressure in the working space 24 is transmitted to the channel 28 to close the inlet valve 26 and open the outlet valve 27.

As the piston 20 is moved upwardly, the size of the space 42 decreases. This results in lubricating fluid being pumped out of the space 42 to the space 35 through the choke channel 45. The lubricating fluid then flows through the large diameter passage 40 to a storage chamber 110.

The lubricant fed via the channel 95 arrives at the outer face of the cylindrical section 30*a* of the driving member 30, the latter being guided to be able to slide coaxially with respect to the cylinder 25. The lubricant then flows via lubricant channels 47 to the pressure areas 4 and on into the return collector 120. This lubricant circuit is also thereby closed.

The return pump 105 via a channel 115 sucks out of the bottom part of the collector 120 and delivers via a rising return channel 106 into the region 110*a* at the crown of the storage chamber 110. An effective deaeration of the flow of lubricant entering the storage chamber thereby results. For reliable filling of the return pump a bypass channel 130 is provided, which connects the suction space of the pump, i.e., the bottom part of the collector 120, to the storage chamber 110 to prevent this space from being sucked empty. For restriction of the bypass a correcting member is provided, for which purpose, for example, an adjustable choke 135*a* may be adequate. In the case of the example, on the contrary, bypass regulation with a controllable valve 135 as the correcting member and a float 140 as the regulating device is provided. This allows the maintenance of an optimum state of fill in the suction space of the return pump 105. Adequate filling of the return pump is essential in particular also for the avoidance of the formation of foam which would impair reliable forced-feed lubrication.

In FIG. 2 the forced-feed lubrication system of the pump is reproduced diagrammatically in a clear form, the essential operational components being shown symoblically but with the same reference numbers as are provided in FIG. 1.

As already mentioned, the avoidance of the formation of foam in the delivery system of the forced-feed lubrication is essential for satisfactory operation. This purpose is served in particular by the construction illustrated in FIGS. 3 and 4 of the rotor 105*a* of the return pump 105 with a plurality of slits made as pressure chambers 105*b* which are arranged after the style of radial centrifugal pump and extend along a difference in radius with respect to the axis of rotation XX of the pump. The lubricant lying in these pressure chambers undergoes because of the heavy centrifugal forces a separation between lubricant having a high and low liquid content respectively or vice versa a low and high gas or foam content. In the region of a discharge control opening 108 extending round less than 180°, in the case of suitable retardation or throttling of the discharge from the pump, essentially only that part of the lubricant is ejected radially out of the pressure chambers 105*b*, which exhibits only a very low gas or foam content. Subsequently the pressure chambers come into connection with a discharge control opening 109*b* which accepts the part of the lubricant which is rich in gas or foam and returns it into the collector 120 via a discharge channel 109*c* not shown in greater detail. In the region between the discharge control openings 108 and 109*b* which as shown in FIG. 3 extend in like manner round an angle of considerably less than 180°, the pressure chambers 105*b* are closed at their outer ends by an inner face 107 of the housing, so that this part of the rotation is available for separation of the portions of lubricant of different densities without disturbance because of through-flow.

A further mechanism which contributes to the gas and foam separation inside the rotor of the return pump is indicated in FIG. 4. According to that, by means of a comparatively wide clearance volume 109*a* arranged axially next to the rotor 105*a* and here shown of a greatly distorted size, a radial circular flow may be generated with a pattern indicated at A, which favours the collection of the lubricant low in gas in the radially outer regions of the pressure chambers 105*b* and if necessary also brings about or favours a partial return in the direction towards the suction space in the pump, of the foam collected in the radially inner regions of the storage chambers.

It should be particularly mentioned that the compact foam of construction of the pump which can be seen from FIG. 1, is further favoured by a prefeed pump 150 for the working medium of the pump being accommodated inside the annular lubricant storage chamber 110 arranged at the endface of the cylinders 25.

In the case of the execution of the pump illustrated in FIGS. 5 and 6 a cooling device for the lubricant, designated as a whole by 200, is accommodated inside the annular lubricant storage chamber 110. This cooling device consists essentially of a heat exchanger 210 which exhibits a channel system 212 which can be seen in detail from FIG. 6 and through which flows the working medium of the pump. The flow of the working medium in this channel system is achieved by means of the prefeed pump 150 already mentioned, which is accommodated coaxially with the annular storage chamber 110 as well as by axial overlapping in its inner recess 140. The inlet side 160 of the prefeed pump 150 lies in the region of an axial end cover 155 of the pump housing which lines up with an endwall 230 closing off the storage chamber 110. The prefeed pump is in the case of the example made as an axial-flow pump the rotor of which in the way which may be seen diagrammatically from FIG. 5 is seated on the pump shaft 1 and the outlet side 170 of which is connected by radial channels 172 to an annular channel 174. Axial branch channels 176 lead from the latter (in FIG. 5 only one of these channels is shown) to the individual pump cylinders (not shown in greater detail) arranged in the form of a star. In this way the cylinder-piston arrangements of the pump obtain the working medium at an inlet pressure of, for example, a few atmospheres gauge which is adequate for reliable filling during the suction stroke of the piston.

Sections 178 of the channels prolonged towards the rear connect the outlet side 170 of the prefeed pump 150 to an annular channel 180 in a central section 232 of the endwall 230 inserted like a cover. A radial channel 182 leads from an annular channel 180 to an inlet distributor 216 of the heat exchanger 210, inserted in the outer part of the endwall 230. From this inlet distributor arranqed in the lower crest region of the storage chamber 110 the partial flow of the cool working medium branched off from the outlet side of the prefeed pump arrives via a channel system 212 in the heat exchanger 210, which may be seen in detail from FIG. 6, at an outlet collector 218 arranged in the upper crest region crown of the storage chamber 110, i.e., diametrically opposite the inlet distributor 216. The outlet collector is likewise inserted in the outer part of the endwall 230. The outlet collector is connected via a radial channel 184 to the suction side 160 of the prefeed pump. Hence there results for the branched-off portion of the discharge flow from the prefeed pump 150 a return circuit in parallel with the main discharge flow, which is led to the inlet side of the main pump. In order to be able to adjust the bridging and the pressure ratios of the prefeed pump 150 suitably, taking into consideration the return circuit, a throttle screw 220 is inserted in the endwall 230, the tip of which engages the channel 182 and forms here an adjustable choke point in the partial discharge flow to the inlet distributor 216.

The construction of the heat exchanger can be seen in detail from FIG. 6. According to that, the channel system 212 of the heat exchanger lies practically completely immersed inside the lubricant storage chamber 110 and below the surface of the lubricant. Because of the opening of the return flow channel 106 from the lubricant return pump 105 into the upper region 110*a* at the crown of the storage chamber 110 and the suction by the pressure lubrication pump 100 in the bottom region of the crown a lubricant flow results in the annular storage chamber, which runs essentially in both circumferential directions from the upper region at the crown downwards to the lower region of the crown. This flow is evidently directed in the opposite sense to the flow of working medium in the channel system of the heat exchanger 210 between the lower inlet distributor 216 and the upper outlet collector 218. Thus, there results between the lubricant throughput in the storage chamber 110 on one side and the flow of working medium in the channel system of the heat exchanger 210 on the other side a transfer of heat in contraflow and hence intensive cooling of the lubricant by the freshly entering working medium.

For the construction of the heat exchanger the following applies in detail with reference to FIG. 6: The channel system 212 of the heat exchange 210 comprises a plurality of annular heat exchanger tubes 214 which extend in the direction circumferential to the storage chamber 110 and which—as already mentioned—lie essentially below the surface of the lubricant and therefore enable exchange of heat over their whole surface. On both sides of the inlet distributor 216 and the outlet collector 218 a plurality of heat exchanger tubes 214 is in each case connected, which are connected in parallel with one another and made arched to fit the annular shape of the storage chamber 110. The result is an essentially cylindrical arrangement of heat exchanger tubes lying side by side in the direction axial to the cylinder, i.e., an arrangement of heat-transfer surfaces of large areas adapted to the spatial proportions of the storage chamber and to the lubricant flow.

Evidently for this intensively acting heat exchanger arrangement there is no additional space requirement because the whole arrangement is accommmodated inside the lubricant storage chamber which exists anyhow. The annular form of the last mentioned chamber enables not only space-saving integration into the overall structure of the machine housing but forces flow of lubricant in the direction circumferential to the storage chamber along the heat exchanger tubes in the sense of the contraflow cooling.

I claim:

1. A piston-machine, in particular a piston-pump, having at least one cylinder-piston arrangement for the formation of a pulsating working space, a flexibly deformable tubular sealing member which is housed in said cylinder and serves to seal the working space and which bears via a liquid, in particular a lubricant, for sliding against a bearing surface, where a driving mechanism, in particular a rotary driving mechanism is provided for the piston, characterized in that with each piston (20) there is associated a cup-like driving member (30) which embraces the associated cylinder (25) externally and extends over at least part of the length of the cylinder and can be set in oscillatory motion by the driving mechanism and in that a pulsating secondary space (35) formed at the outside of the cylinder (25) by the driving member (30) to correspond with the oscillating working motion is connected via at least one balancing channel (40) of large cross-sectional area to a pressure-balancing chamber.

2. A piston-machine as in claim 1, characterized in that as the pressure-balancing chamber for the pulsating secondary space (35) a storage chamber for lubricant or conveying medium is provided.

3. A piston-machine as in claim 1, characterized in that the pulsating secondary space (35) is connected through a choke channel (45) to a space (42) which lies at the end (25*a*) of the cylinder inside the driving member (30) and pulsates to correspond with the oscillating working motion.

4. A piston-machine as in claim 3, characterized in that the choke channel (45) is formed by a clearance volume between the inner face of the driving member (30) and the outside of the cylinder (25).

5. A piston-machine, in particular a piston-pump, having at least one cylinder-piston arrangement for the formation of a pulsating working space having force-feed lubrication which comprises a pressure lubrication pump, a return collector, a return pump and a storage chamber feeding the pressure lubrication pump, a flexibly deformable tubular sealing member which is housed in said cylinder and serves to seal the working space and which bears via a liquid, in particular a lubricant, for sliding against a bearing surface, where a driving mechanism, in particular a rotary driving mechanism is provided for the piston, characterized in that with each piston (20) there is associated a cup-like driving member (30) which embraces the associated cylinder (25) externally and extends over at least part of the length of the cylinder and can be set in oscillatory motion by the driving mechanism and further characterized by a bypass channel (130) connecting the storage chamber (110) to the return collector (120).

6. A driving motor or work machine as in claim 5, characterized by a bypass channel (130) having an adjustable or controllable correcting member (135) for restriction of the flow from the storage chamber (110) to the return collector (120).

7. A driving motor or work machine as in claim 6, characterized in that for the return collector a regulating or control device (140) is provided for the maintenance of a minimum filling and that this control or regulating device (140) is in operative connection with the correcting member (135) for the flow in the bypass channel (130).

8. A pump assembly comprising a housing having surface means for defining a cylindrical housing chamber, a reciprocatable working member disposed in said housing chamber, said working member having a head end portion and a tubular sidewall connected to the head end portion and having a cylindrical inner side surface and a cylindrical outer side surface which is disposed in engagement with said surface means, said head end portion of said working member having an inner side surface which partially defines a fluid receiving chamber, a tubular cylinder member fixedly connected with said housing and disposed in a telescopic relationship with said tubular sidewall of said working member, said cylinder member having a cylindrical inner side surface and a cylindrical outer side surface which cooperates with the inner side surface of the tubular side wall of said working member to at least partically define a first lubricant flow passage connected in fluid communication with the fluid receiving chamber, a piston disposed within said cylinder member, deformable tubular sealing means disposed within said cylinder member, said sealing means having a first end portion connected with said housing, a second end portion connected with said piston, an inner side surface which at least partially defines a variable volume working chamber, and an outer side surface which cooperates with the inner side surface of said cylinder member to at least partially define a second lubricant flow passage connected in fluid communication with the fluid receiving chamber, working fluid supply means for supplying fluid to the variable volume working chamber, drive means for reciprocating said working member and piston relative to said housing and cylinder member to deform said tubular sealing means and vary the size of said variable volume working chamber to pump fluid from said pump assembly, and lubricating fluid supply means for inducing a flow of fluid to and from said fluid receiving chamber through said lubricant flow passages during reciprocation of said working member and deformation of said tubular sealing means.

9. A pump assembly as set forth in claim 8 wherein said fluid receiving chamber is least partially defined by an end portion of said cylinder member, said fluid receiving chamber being varied in volume by reciprocation of said working member to pump fluid from said fluid receiving chamber to one of said lubricant flow passages.

10. A pump assembly as set forth in claim 8 and further including main reservoir means for holding a supply of fluid to be conducted to said variable volume working chamber, collector reservoir means for receiving fluid conducted to said pump assembly, return pump means for pumping fluid from said collector reservoir means to said main reservoir means, bypass passage means for conducting fluid from said main reservoir means to said collector reservoir means, and control valve means for controlling fluid flow through said bypass passage means as a function of the amount of fluid in said collector reservoir means to maintain at least a minimum amount of fluid in said collector reservoir means.

11. A pump assembly as set forth in claim 10 further including infeed pump means for pumping fluid from said main reservoir means to the variable volume working chamber.

12. A pump assembly as set forth in claim 8 wherein said pump assembly further includes main reservoir means for holding fluid said lubricating fluid supply means including lubricant pump means for pumping fluid from said main reservoir means to one of said lubricant flow passages and return passage means for conducting a flow of fluid from the other one of said lubricant flow passages to said main reservoir.

13. A pump assembly as set forth in claim 12 wherein said working fluid supply means includes infeed pump means for pumping fluid from said main reservoir means to the variable volume working chamber.

14. A pump assembly as set forth in claim 13 wherein said lubricant pump means and said infeed pump means are driven by said drive means.

15. A pump assembly as set forth in claim 8 wherein said drive means includes a rotatable drive shaft and eccentric means connected with said drive shaft for reciprocating said working member and piston to pump fluid from said variable volume working chamber upon rotation of said drive shaft, said pump assembly further including main reservoir means for holding a supply of fluid, infeed pump means connected in fluid communication with said main reservoir means and the variable volume working chamber and driven by said drive shaft for pumping fluid from said main reservoir means to the variable volume working chamber upon rotation of said drive shaft, said lubricating fluid supply means including lubricant pump means connected in fluid communication with said main reservoir means and one of said lubricant flow passages and driven by said drive shaft for pumping fluid from said main reservoir means to the one lubricant flow passage upon rotation of said drive shaft.

16. A pump assembly as set forth in claim 15 further including collector reservoir means for receiving fluid conducted to said pump assembly, return fluid pump means connected in fluid communication with said collector reservoir means and said main reservoir means and driven by said drive shaft for pumping fluid from said collector reservoir means to said main reservoir means upon rotation said drive shaft.

17. A pump assembly as set forth in claim 16 further including bypass passage means for conducting fluid from said main reservoir means to said collector reservoir means and control valve means for controlling the flow of fluid through said bypass passage means to maintain a minimum quantity of fluid in said collector reservoir means.

* * * * *